United States Patent [19]

Burgess et al.

[11] Patent Number: 4,671,801

[45] Date of Patent: Jun. 9, 1987

[54] METHOD FOR THE BENEFICIATION, LIQUEFACTION AND RECOVERY OF COAL AND OTHER SOLID CARBONACEOUS MATERIALS

[75] Inventors: Lester E. Burgess, Swarthmore; Robert G. Hagstrom, Wayne; David E. Herman, Jim Thorpe; Phillip E. McGarry, Palmerton, all of Pa.

[73] Assignee: The Standard Oil Company, Cleveland, Ohio

[21] Appl. No.: 757,025

[22] Filed: Jul. 19, 1985

Related U.S. Application Data

[63] Continuation of Ser. No. 230,052, Jan. 29, 1981, abandoned.

[51] Int. Cl.[4] ..... C10L 1/32

[52] U.S. Cl. ..... 44/51; 44/15 R; 208/14

[58] Field of Search ..... 44/51, 15 R; 208/14

[56] References Cited

U.S. PATENT DOCUMENTS

| | | | |
|---|---|---|---|
| 4,153,421 | 5/1979 | Marlin | 44/51 |
| 4,290,777 | 9/1981 | Czenkusch | 44/15 R |
| 4,304,573 | 12/1981 | Burgess et al. | 44/68 |

*Primary Examiner*—Jacqueline V. Howard

*Attorney, Agent, or Firm*—Bruce E. Harang; David T. Untener; Larry W. Evans

[57] ABSTRACT

An integrated, continuous (or batch) process for the beneficiation and/or liquefaction of coal, especially low rank coals, is provided, the process generally involving admixing coal with an organic liquid medium under high shear agitation, further beneficiating the coal by admixing the same in an aqueous medium optionally containing a monomer and a polymerization catalyst therefor and subjecting the resultant coal product to further high shear agitation in the presence of certain organic liquid media to provide a liquefied coal extract product and a further solid coal product. Beneficiated solid and liquefied coal products are also provided.

27 Claims, 4 Drawing Figures

METHOD FOR THE BENEFICIATION, LIQUEFACTION AND RECOVERY OF COAL AND OTHER SOLID CARBONACEOUS MATERIALS

This is a continuation of co-pending application Ser. No. 230,052 filed on Jan. 29, 1981, now abandoned.

BACKGROUND OF THE INVENTION

This invention relates to a process for the beneficiation of coal and solid carbonaceous fuel materials, and more particularly to an improved process for the beneficiation and enhanced recovery of coal.

Known resources of coal and other solid carbonaceous fuel materials in the world are far greater than the known resources of petroleum and natural gas combined. Despite this enormous abundance of coal and related solid carbonaceous materials, reliance on these resources, particularly coal, as primary sources of energy, has been for the most part discouraged. The availability of cheaper, cleaner burning, more easily retrievable and transportable fuels, such as petroleum and natural gas, has in the past, cast coal to a largely supporting role in the energy field.

Current world events, however, have forced a new awareness of global energy requirements and of the availability of those resources which will adequately meet these needs. The realization that reserves of petroleum and natural gas are being rapidly depleted in conjunction with skyrocketing petroleum and natural gas prices and the unrest in the regions of the world which contain the largest quantities of these resources, has sparked a new interest in the utilization of solid carbonaceous materials, particularly coal, as primary energy sources.

As a result, enormous efforts are being extended to make coal and related solid carbonaceous materials equivalent or better sources of energy, than petroleum or natural gas. In the case of coal, for example, much of this effort is directed to overcome the environmental problems associated with its production, transportation and combustion. For example, health and safety hazards associated with coal mining have been significantly reduced with the onset of new legislation governing coal mining. Furthermore, numerous techniques have been explored and developed to make coal cleaner burning, more suitable for burning and more readily transportable.

Gasification and liquefaction of coal are two such known techniques. Detailed descriptions of various coal gasification and liquefaction processes may be found, for example, in the *Encyclopedia of Chemical Technology,* Kirk-Othmer, Third Edition (1980) Volume 11, pages 410–422 and 449–473. Typically, these techniques, however, require high energy input, as well as the utilization of high temperature and high pressure equipment, thereby reducing their widespread feasibility and value.

Processes to make coal more readily liquefiable have also been developed. One such process is disclosed in U.S. Pat. No. 4,033,852 (Horowitz, et al) incorporated by reference herein. This process involves chemically modifying the molecular structure of the coal, the effect of which alters its morphology and thus renders a portion of the coal more readily liquefiable than the natural forms of coal.

In addition to gasification and liquefaction, other methods for converting coal to more convenient forms for burning and transporting are also known. For example, the preparation of coal-oil and coal-aqueous mixtures are described in the literature. Such liquid coal mixtures offer considerable advantages. In addition to being more readily transportable than dry solid coal, they are more easily storable, and less subject to the risks of explosion by spontaneous ignition. Moreover, providing coal in a fluid form makes it feasible for burning in conventional apparatus used for burning fuel oil. Such a capability can greatly facilitate the transition from fuel oil to coal as a primary energy source. Typical coal-oil and coal-aqueous mixtures and their preparation are disclosed in U.S. Pat. Nos. 3,762,887, 3,617,095 and 4,217,109 and British Pat. No. 1,523,193.

Regardless, however, of the form in which the coal is ultimately employed, the coal must be cleaned because it contains substantial amounts of sulfur, nitrogen compounds and mineral matter, including significant quantities of toxic metal impurities. During combustion these materials enter the environment as sulfur dioxides, nitrogen oxides and compounds of toxic metals. If coal is to be accepted as a primary energy source, it must be cleaned to prevent pollution of the environment.

Accordingly, chemical as well as physical coal cleaning (beneficiation) processes have been extensively explored. In general, physical coal cleaning processes involve pulverizing the coal to release the impurities, wherein the fineness of the coal generally governs the degree to which the impurities are released. However, because the costs of preparing the coal rise exponentially with the amount of fines produced, there is an economic optimum in size reduction. Based on the physical properties that effect the separation of the coal from the impurities, physical coal cleaning methods are generally divided into four categories: gravity, flotation, magnetic and electrical methods.

In contrast to physical coal cleaning, chemical coal cleaning techniques are in a very early stage of development. Known chemical coal cleaning techniques include, for example, oxidative desulfurization of coal (sulfur is converted to a water-soluble form by air oxidation), ferric salt leaching (oxidation of pyritic sulfur with ferric sulfate), and hydrogen peroxide-sulfuric acid leaching. Other methods are also disclosed in the above-noted reference to the *Encyclopedia of Chemical Technology,* Vol. 6, pages 314–322.

A recent promising development in the art of chemical coal beneficiation is disclosed in copending U.S. patent applications Ser. Nos. 114,357 and 114,414, each filed Jan. 22, 1980 and in U.S. Government Report No. 2694 entitled "Fuel Extension by Dispersion of Clean Coal in Fuel Oil" all incorporated herein by reference. In summary, according to this coal beneficiation process, coal is first cleaned of rock and the like and pulverized to a fine size. The pulverized coal, now in the form of a water slurry, is then contacted with a mixture comprising a polymerizable monomer, and a polymerization catalyst. The resultant surface treated coal is highly hydrophobic and the oleophilic and is thus readily separated from unwanted ash and sulfur using oil and water separation techniques. Moreover, the hydrophobic coal can be readily further dehydrated to very low water levels without employing costly thermal energy. The clean, very low moisture content coal resulting from this process can then be employed as is, i.e., as a dry solid product, or further processed to advantageous coal-oil or coal-aqueous mixtures.

In any coal cleaning process, whether it be physical or chemical, the recovery of maximum yields of useable product is always an important economic concern. Much effort has also been devoted to the recovery of the huge amounts of residual coal fines which are generated during all coal beneficiation processes.

One recovery method, for example, which has been developed is the froth flotation process which consists of agitating the finely divided coal and mineral suspension with small amounts of frothing reagents in the presence of water and air. The frothihg reagents assist the formation of small air bubbles that collect the hydrophobic coal particles and carry them to the surface. The hydrophilic mineral matter is wetted by water and drawn off as tailings. However, the recovery of fine coal residuals in coal cleaning refuse water using conventional froth flotation is so poor that the procedure is seldom practiced commercially.

On the other hand, U.S. patent application, Ser. No. 06/230,056, filed concurrently herewith discloses a desirable integrated process for the beneficiation and enhanced recovery of product including the recovery of residual coal particles lost in prior art procedures.

A further problem associated with the beneficiation and recovery of coal is the variety of kinds of coal that are naturally found. That is, for example, it is well known that the so-called low rank coals do not respond well to beneficiation using conventional flotation processes, particularly because the beneficiated products do not float well. However, a desirable and improved process for beneficiating and recovering low rank coal is disclosed and claimed in U.S. patent application, Ser. No. 06/230,060 filed Jan. 29, 1981.

Accordingly, other methods for the improved beneficiation and enhanced recovery of coal, including residual coal fines, would obviously be very desirable. Of particular importance is a method which not only provides for an improved beneficiated product in high yield but also which is suitable for the beneficiation and good recovery of low rank coals not normally suitable for beneficiation. In addition, other processes for the liquefaction of coal would also be welcome, not to mention the desirability for a process which has the capability of achieving all the aforementioned goals but also provides for the liquefaction of coal and moreover the recovery of clean liquefied coal product.

SUMMARY OF THE INVENTION

Accordingly, it is one object of the present invention to provide a process for the beneficiation and increased recovery of coal and other solid carbonaceous materials.

Another object of this invention is to provide a coal beneficiation process which provides a beneficiated coal product which is cleaner and more suitable for combustion than provided with conventional processes.

Still another object of this invention is to provide a coal beneficiation process which provides a beneficiated coal product which, in addition to being very low in ash, sulfur and water content, also possesses enhanced energy content.

A further object of the present invention is to provide a coal beneficiation process which provides a beneficiated coal product which is highly suitable for forming coal-oil and/or coal-aqueous mixtures which in turn are readily storable, readily transportable and readily burnable.

A still further object of this invention is to provide a coal beneficiation process which provides for the increased recovery of more residual-coal fines than provided by conventional processes.

Another object of this invention is to provide a process for the beneficiation and enhanced recovery of low rank coals.

An even further object of the present invention is to provide a process for the liquefaction of coal, including low rank coal.

A still further object of the invention herein is to provide an integrated and continuous process which provides all of the hereinbefore recited objects.

These and other objects are accomplished herein by a beneficiation and recovery process which comprises the steps of:

(a) subjecting water-wetted pulverized raw coal to a beneficiation treatment by admixing said pulverized water-wetted coal, under high shear agitation, with a water-insoluble liquid organic medium; and (b) recovering the clean coal.

Other embodiments herein are achieved by a process which further includes the steps of:

(c) admixing the coal containing mixture of step (a) with at least one aqueous medium, thereby resulting in a coal froth phase, and an aqueous phase, separating the coal froth phase from the aqueous phase;

(d) removing residual water and liquid organic medium from the cleaned coal;

(e) admixing, under high shear agitation, the cleaned coal from step (d) with a mixture comprising at least one member selected from the group consisting of a polymerizable monomer, a polymerization catalyst and a fluid organic medium.

DETAILED DESCRIPTION OF THE INVENTION

Figure 1:
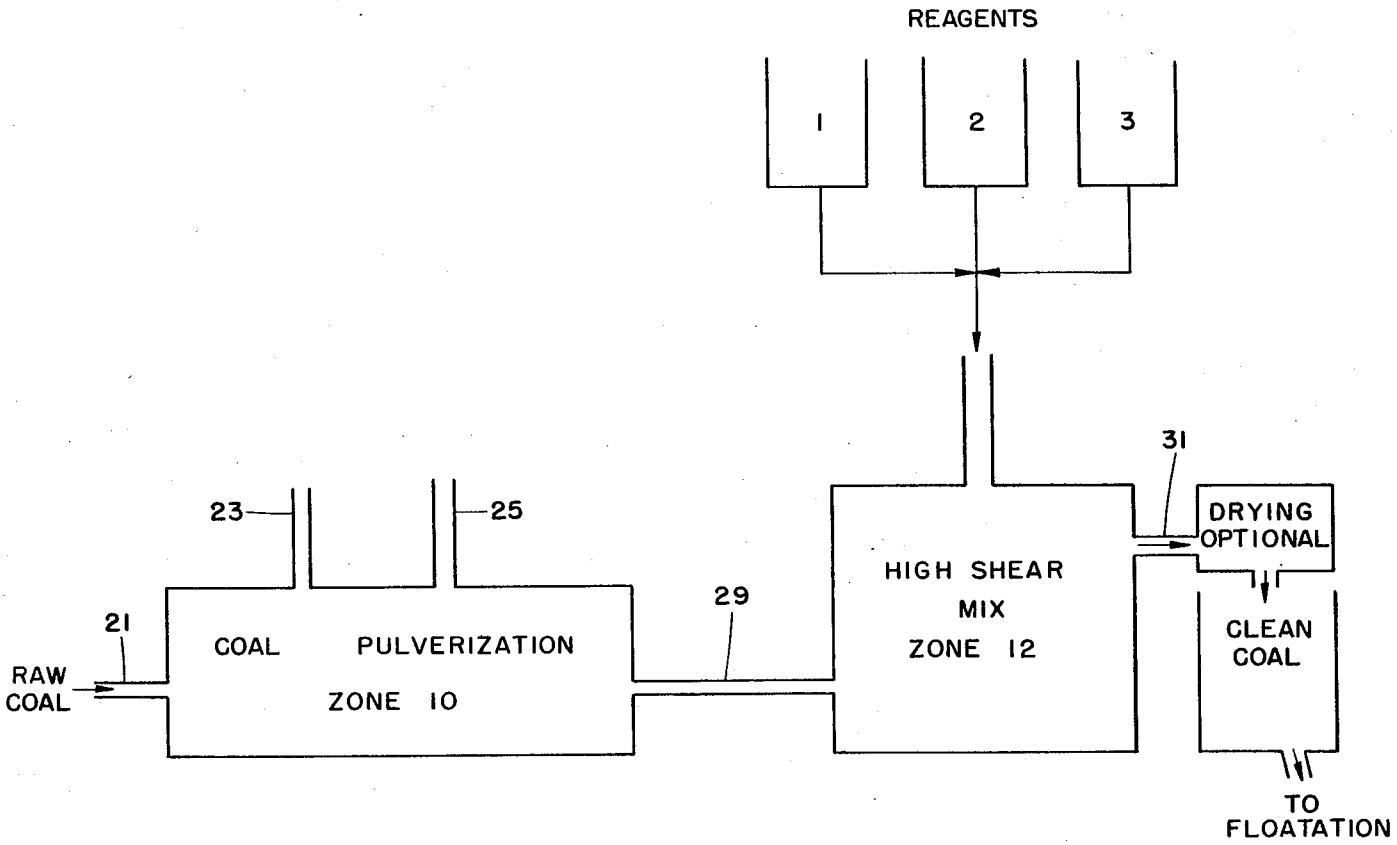
FIG. 1 is a block diagram illustrating one embodiment of the process of the present invention.

Referring to the drawing, FIG. 1 illustrates the basic sequence of steps for carrying out process of the present invention. Thus, in the practice of the present invention, it is initially preferred to reduce raw mined coal or other solid carbonaceous materials to a fine diameter size and to remove the unwanted rock, heavy ash and the like materials collected in the mining operation. As shown in FIG. 1, raw coal which has previously been crushed and removed of rock and heavy ash such as by using breakers, jigs and the like, is introduced to pulverization zone 10 through conduit 21 where the raw coal is pulverized and initially cleaned, usually in the presence of water, which may be introduced through line 23. The coal is ground employing conventional equipment, such as, for example, ball or rod mills. It is generally desirable, although not necessary to the present process, to employ certain water conditioning or treating additives in the pulverization operation. Such additives assist in rendering the ash more hydrophilic, which facilitates the separation thereof. Typical additives which can be introduced through a separate line 25 or through either of lines 21 or 23 and which are useful for purposes herein, include conventional inorganic and organic dispersants, surfactants, and/or wetting agents. Preferred additives for this purpose include sodium carbonate, sodium pyrophosphate, and the like.

The coal-aqueous slurry formed in pulverization zone 10 is typically one having a coal to water ratio of from about 1 to about 19 and preferably about 1:4 parts by weight, respectively. Also, ratios of 2:1 (coal to water) are also contemplated. 1:1 (coal to water) is also preferably used. If utilized, water conditioning additives as hereinbefore described are employed in small amounts, usually, for example, from about 0.025 to about 5%. While it is generally recognized that more impurities are liberated as the size of the coal is reduced, the law of diminishing returns applies in that there is an economic optimum which governs the degree of pulverization. In any event, for the purposes of this invention, it is generally desired to grind the coal to a particle size of from about 48 to about 300 mesh, preferably about 80% of the particles being finer than about 200 mesh size.

Any type coal can be employed in the process of the present invention. Typically, these include, for example, bituminous coal, sub-bituminous coal, anthracite, lignite and the like. Other solid carbonaceous fuel materials, such as oil shale, tar sands, and the like are also contemplated for treatment by the process herein. Thus, for the purposes of this invention, the term "coal" is also intended to include these kinds of other solid carbonaceous fuel materials. Moreover, it has been found herein that the present process is particularly well suited for beneficiating low rank coals, e.g. lignite, low rank bituminous, sub-bituminous and peat.

The coal-aqueous slurry, which exits pulverization zone 10 through conduit 29 is fed to a high shear, i.e. high speed agitation, zone 12 wherein the pulverized coal is contacted, at a temperature of from about 40° C. to about 95° C. preferably 50-80° C. for a period of from about 15 seconds to about 15 minutes and admixed under high speed agitation, with an organic water insoluble liquid medium added by means of any of reagent tanks 1, 2 or 3. It has been found herein that the presence of the organic water insoluble liquid at this stage in the process results in a "deep" cleaning of the coal, especially with coals which are generally very difficult to clean, such as the aforementioned low rank coals. While not completely understood, it is believed that the organic water insoluble liquid operates to drive the moisture (if present) from the coal, thus allowing reaction with the polymerizable reaction composition (in sub-bituminous and lignite it is believed that the water of hydration offers a barrier to surface reaction) which leads to heterogenous separation of the organic phase from the water and accordingly enhances ash separation.

Thus, the beneficiated coal recovered from zone 12, via line 31, after removal of residual water and liquid hydrocarbons, by drying and solvent extract techniques (if desired) for example, has a low moisture content of from about 5% to about 30%, a low ash content of from about 1% to about 10% and a low sulfur content of from about 0.1 to about 6%, preferably 0.3 to 2%, depending on the coal feed. This product is a highly desirable one and is therefore suitable for use as is or may be further treated and cleaned in accordance with the following discussion encompassing further embodiments of the present invention.

Water-insoluble organic liquids which are suitable in high shear mix zone 12 are generally any solvents or other fluid medium which will sufficiently wet the coal to permit ash separation. Generally, water insoluble organic liquids suitable for the purposes of this invention are low boiling liquids, i.e. boiling point from about 40° C. to about 80° C. Such liquids include benzene, toluene, xylene, hydrocarbon oils, pyridine, cyclohexane, ethyl acetate and mixtures thereof. For the purposes of this invention, benzene and toluene are preferred, toluene being most preferred. It has been found that the presence of the organic liquid such as toluene, in the high shear mix zone 12, increases the recovery of clean coal by up to about 30%. Other additives and/or reagents including monomer, catalyst (described in greater detail hereinafter) may also be added to the high shear mix zone, if desired, by means of any of tanks 1, 2 or 3, for example.

The clean coal from high shear mix zone 12 may be further cleaned in accordance with the present invention to provide an even cleaner, i.e. a "super clean" coal product. This is accomplished in accordance with the process outlined by FIG. 2. Thus, referring to FIG. 2, the coal containing mixture exiting high shear mix zone 12 is fed to a first flotation zone 14 through line 31. In flotation zone 14, the coal-organic liquid mixture is contacted and admixed with an aqueous medium. This aqueous medium in flotation zone 14 may comprise simply water or in addition to water other surface treating additives may be present. That is, for example, the aqueous medium of flotation zone 14 may comprise a chemical treating mixtures comprised of water, a polymerizable monomer and polymerization catalyst. These ingredients can be introduced, for example, to zone 14 through lines 33, 35 and 37, respectively. If desired, a further amount of organic liquid hereinbefore (and hereinafter) described, can also be added to the aqueous medium of zone 14 such as via line 39. This organic liquid may be the same or different from that employed in high shear mix zone 12; preferably, it is the same.

In a preferred embodiment of the present invention, the coal containing mixture from zone 12 is sprayed, most preferably through a pressure spray nozzle, into flotation zone 14. Spraying further facilitates the separation of ash from coal by assisting in breaking up any flocs of coal which may include trapped ash. Moreover, in order to encourage frothing it is also preferred herein to spray the surface treating ingredients into flotation zone 14 such as through line 33 (water), 35 (monomer) 37 (catalyst) and 39 (catalyst initiator). Frothing takes place in flotation zone 14 thus providing a floating coal froth phase and an aqueous phase.

Figure 4:
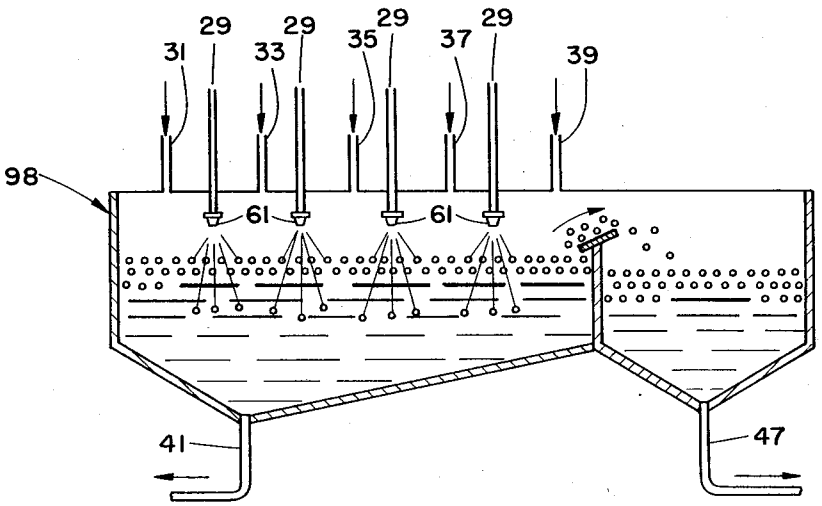
FIG. 4 is a schematic illustration of a preferred vessel in which raw coal is subjected to surface treatment and/or froth flotation according to the present process.

FIG. 4 illustrates a unit 55 which is suitable as a froth flotation vessel useful in zone 14 or any of flotation and flotation recovery zones employed in the present process. In this unit, the coal-organic liquid mixture is sprayed into the vessel through line 29 and through spray nozzle 61. The treating reagents may be added by way of lines 33, 35, 37 and 39. As indicated hereinabove and although not shown in FIG. 4, these ingredients may be fed to the vessel through spray nozzles also. These agents can be added directly to the liquid media in the pulverization zone, in the organic liquid medium or in water or separately in lines leading to the zones or vessels. Vessels of the type shown in FIG. 4, employing spray nozzles, are disclosed and claimed in U.S. patent applications, Ser. Nos. 06/230,058 and 06/230,059, both filed concurrently herewith and commonly assigned herewith and incorporated herein by reference.

These U.S. applications describe and claim a particularly effective technique for separating the treated coal particles from unwanted ash and sulfur in the water phase utilizing an aeration spray technique wherein a coal froth phase is formed by spraying or injecting the treated coal-water slurry into the surface of cleaning water. Briefly, according to the method and apparatus there described the coal slurry is injected through at least one spray nozzle at pressures, for example, at from about 15–20 psi at a spaced-apart distance above the water surface into the water surface producing aeration and a frothing or foaming of the coal particles, causing these particles to float to the water surface for skimming off.

The surface treating conditions utilized in zone 14, will, of course, vary depending upon the specific reactants employed. Generally, however, any conditions which result in the formation of a hydrophobic and oleophilic surface on the coal can be utilized. More specifically, typical conditions include, for example, temperatures in the range of from about 10° C. to about 90° C., atmospheric to nearly atmospheric pressure conditions and a contact time, i.e. reaction time, of from about 0.02 to about 10 minutes. Preferably, the chemical reaction, is carried out at a temperature of from about 15° C. to 60° C. and atmospheric pressure for about 2 minutes.

The coal froth phase, which ensues in zone 14, is readily separated from the aqueous phase, which is also formed therein, by conventional means, for example, skimming. The beneficiated solid coal product resulting at this point in the process is even further cleaned of impurities, including ash and sulfur. Preferably, however, it is fed to further flotation zone 16 through line 41 for further cleaning. Concomitantly, the aqueous phase remaining in zone 14, which contains residual coal particles or fines and ash, is removed from zone 14 and sent to flotation recovery zone 20 through line 43. Similar to the manner described hereinbefore for the introduction of materials to zone 14, the aqueous phase from zone 14 is preferably fed to zone 20 through a pressure spray nozzle, thereby facilitating further frothing. Recovery zone 20 comprises an aqueous medium typically contained in a froth flotation unit as illustrated in FIG. 4 herein. It has been surprisingly discovered that in contrast to prior art froth flotation recovery operations, merely admixing, preferably by spraying, the aqueous phase from zone 14 into the aqueous medium of zone 20, causes a significant quantity of the residual coal fines to float, which permits for greater recovery than customarily achieved by processes used heretofore. While it is not completely understood, it is believed that this advantage results from the unique surface treating beneficiation process employed in the present process, wherein the surface of the coal becomes highly hydrophobic and oleophilic. This concept involving the enhanced recovery of residual coal fines and more is disclosed and claimed in copending U.S. application, Ser. No. 06/230,056 filed concurrently herewith and commonly assigned herewith and incorporated herein by reference.

Figure 2:
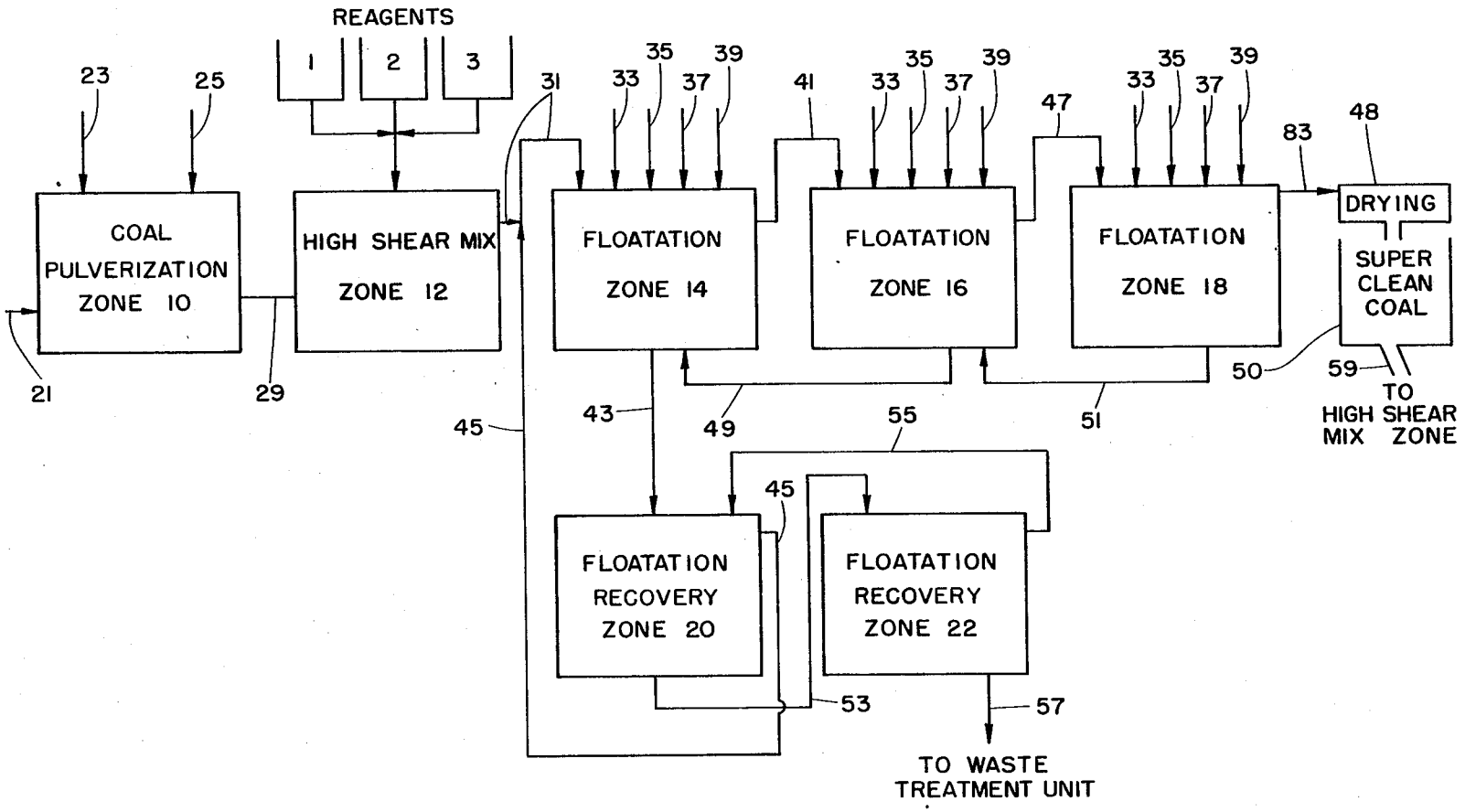
FIG. 2 is another block diagram illustrating a preferred embodiment of the process of the present invention.

In furtherance of the process of the present invention and as shown in FIG. 2, the coal froth phase which ensues in zone 20 is recovered therefrom through line 45 and recycled to either pulverization zone 10 or high shear mix zone 12 (not illustrated) or directly to flotation zone 14 via line 31 (as shown) for further treatment therein. The aqueous phase resulting in zone 20 may be drawn off and sent to a waste disposal unit (not illustrated) or preferably is fed to a further recovery zone 22 as shown. Frothing and/or flotation aids, which assist in the formation of small air bubbles, may be added to recovery zone 20 or 22 for enhanced coal phase separation.

In the continuance of the process herein, the coal froth phase from zone 14 is, at the same time, introduced to a further flotation zone 16, again preferably through pressure spray nozzles, in line 41. Zone 16 is also comprised of an aqueous medium. The coal froth phase, which forms in zone 16 is separated from the aqueous phase which is also formed in zone 16, and preferably introduced to a third flotation zone 18, through line 47, as shown in FIG. 2. Like flotation zones 14 and 16, zone 18 is also comprised of an aqueous medium. Thus a coal froth phase and an aqueous phase also ensues in zone 18.

The coal froth phase is skimmed from flotation zone 18 and then may be fed through line 83 to a drying zone 48 such as a centrifuge or other solvent and/or water removal technique, and used as is. This coal is a "super clean" coal product having a very low ash content of from about 0.5 to about 10%, and a very low moisture content of from about 0.2 to about 15%. Such a coal product is extremely desirable in the formation of coal-aqueous and/or coal-oil mixtures.

Figure 3:
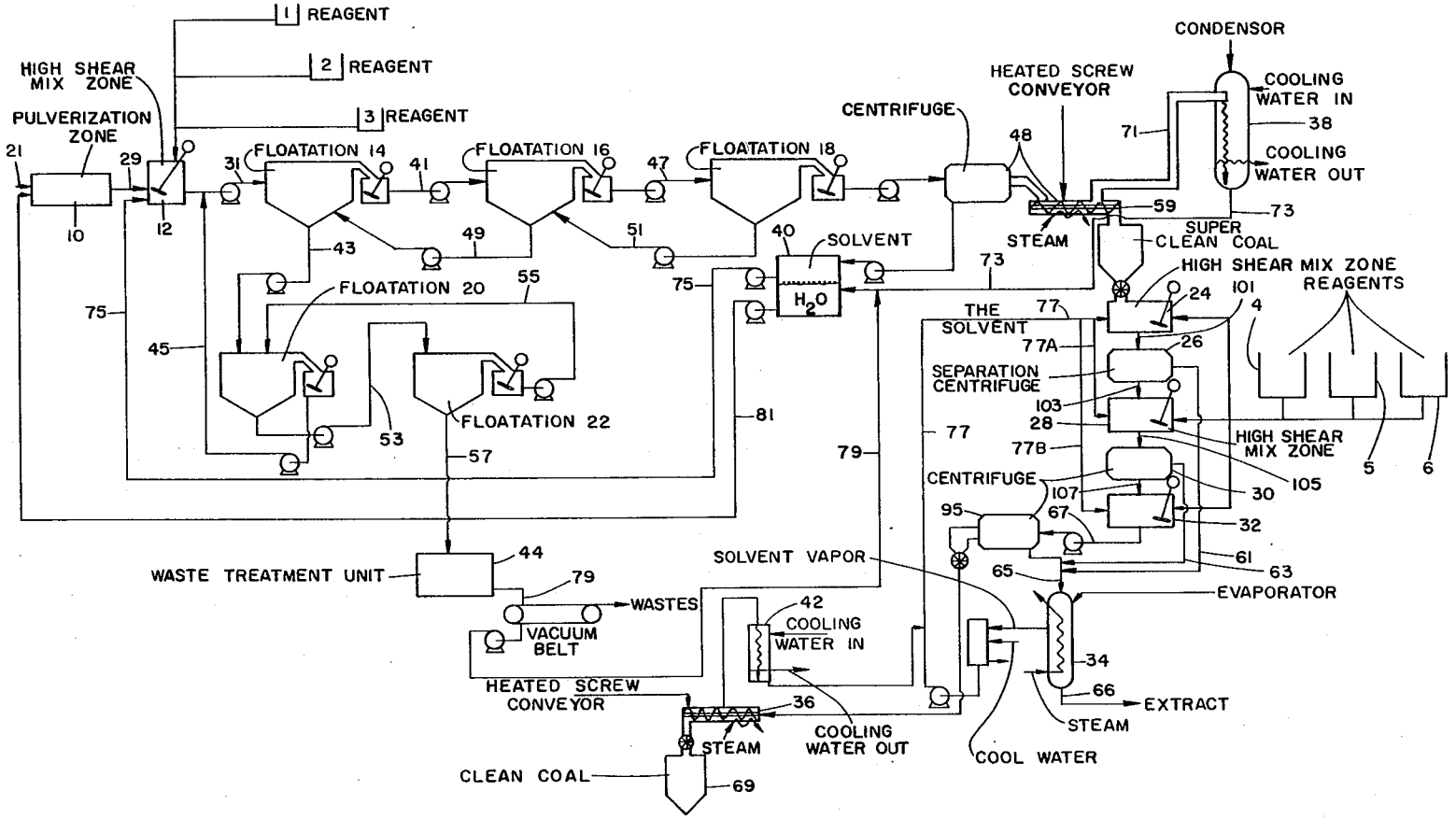
FIG. 3 is a further block diagram schematically illustrating another preferred embodiment of the present invention.

Simultaneous with the continuous formation, separation and removal of the coal froth phases from zones 14, 16 and 20 as described heretofore, the aqueous phases formed in each of these zones are also continuously removed and introduced for further processing as illustrated in FIGS. 2 and 3. That is, the aqueous phase from zone 16 is recycled to zone 14 in a counter-currently flowing stream via line 49, whereby residual coal particles are again subjected to treatment in zone 14. Similarly, the aqueous phase in zone 18, is recycled in a counter-currently flowing stream via line 51 to zone 16 for further processing therein. At the same time, as described before, the aqueous phase from zone 14 is continuously removed therefrom and introduced to flotation recovery zone 20 by way of line 43. As indicated before, the resultant coal froth phase in zone 20 is removed therefrom and recycled to flotation zone 14 for further treatment by way of lines 45 and 31. Concomitantly, the aqueous phase formed in zone 20 is continuously removed and preferably fed to second flotation recovery zone 22 through line 53. The coal froth phase which ensues in zone 22 is removed therefrom and is continuously recycled in counter-current flowing stream to recovery zone 20 via line 55. The aqueous phase in zone 22 is disposed of via line 57 and typically sent to a waste treatment unit 44 as depicted in FIG. 3.

While water may be the only ingredient utilized in the aqueous mediums contained in flotation zones 14, 16 and 18 and flotation recovery zones 20 and 22, it is contemplated herein, particularly in zones 14, 16 and 18 but also in zones 20 and 22, to employ, in addition to water, small amounts of the hereinbefore-mentioned surfactants, dispersing and/or wetting agents, particularly sodium carbonate and sodium pyrophosphate, polymerizable monomer, such as the same or different monomer which may have been employed in the initial surface treatment mixture in flotation zone 14, a small amount of liquid organic carrier, such as fuel oil, a coal derived oil or any of the heretofore and hereinafter recited organic liquids, and a small additional amount of polymerization catalyst, such as the free radical catalyst and/or initiator. The utilization of coal derived oils in this kind of beneficiation process is disclosed and claimed in U.S. patent application Ser. No. 06/230,060 filed concurrently herewith and commonly assigned and incorporated herein by reference.

Furthermore, the residence times of the materials being treated, washed and/or recovered in each of the foregoing identified zones will, of course, vary depending upon the amounts and materials utilized. Residence times which result in optimum frothing and separation of phases are most desirable. Generally, however, any residence time which is sufficient to result in a coal froth phase and an aqueous phase may be utilized. More specifically, these times range from about 0.2 to about 30 minutes.

Alternatively and preferably in another embodiment of the present invention, the super clean coal 50 is now introduced to an extraction procedure wherein further modified and liquefied coal products are produced which are cleaned of even further amounts of inorganic and organic sulfur. The extraction procedure involves high shear agitation, which may include a single stage or a series of high shear mixing stages and treatments.

Thus, referring to FIG. 3, the super clean coal from zone 18, either before drying or after drying, is fed via line 59 to high shear mix 24 wherein the coal is admixed under high speed agitation, with an organic liquid medium comprising an organic liquid, a polymerizable monomer, a free radical catalyst and free radical initiator. After admixture in zone 24, the resultant product is fed via line 101 to a separation zone 26, commonly a centrifuge, wherein the liquids fraction is separated from the solids fraction.

The organic liquid employed in the extraction procedure (in any of zones 24, 28 or 32) may be water insoluble such as those used in zone 12 or they may be water soluble or mixtures thereof. Typical organic liquid mediums used in the extraction process include toluene-alcohol mixtures, benzene-alcohol mixtures, xylene-alcohol mixtures, ethanol, methanol, isopropyl alcohol, methyl ethyl ketone, cyclohexane, pyridine, dimethylformamide, tetrahydrofuran (THF) and the like. THF is preferred.

The liquids fraction from separation zone 26 is fed to a solvent removal zone 34, illustratively shown as an evaporator unit, through line 61. The solids portion from zone 26 is introduced via line 103 to a further high shear mix zone 28 wherein the coal is admixed under high speed agitation with further organic liquid. This organic liquid medium may or may not contain the same ingredients, e.g. monomer, catalyst initiator, as used in zone 24. These ingredients including the organic liquid medium, may be added to any of zones 24, 28 or 32 via reagent tanks 4, 5 and/or 6. Again, the product resulting from zone 28 is fed via line 105 to a separation zone 30 wherein the liquids fraction is separated from solids. The liquids portion is sent to solvent removal zone 34 via line 63 and the solids portion is fed via line 107 to a third high shear mix zone 32 wherein the coal product is again admixed under high speed agitation with further organic liquid hydrocarbon medium which again may or may not contain the same ingredients used in zone 26 and 28. The product resulting from zone 32 is fed through line 67 to a separation zone 95 wherein the liquids fraction is separated from solids. The liquids portion is sent, via line 65, to solvent removal zone 34.

The residual hydrocarbon solvent present in the liquids fraction is removed in zone 34 and a liquefied coal extract product is recovered at line 66. l This combined liquefied coal extract is a highly beneficiated coal product of the present invention and is a low ash (from about 0.1 to about 2%), preferably 0.2 to 1%, low sulfur (from about 0.1 to about 3%), preferably 0.2 to 1% and high BTU carbon product. This liquid extract may be used as a very desirable source of energy and in addition is a valuable feedstock for organic products, particularly aromatic products. The extract which contains some of the extracting solvent can be a fluid true liquid or further evaporated to a viscous fluid. If evaporated to dryness, it can become a redissolvable solid.

The solid coal which exits separation zone 95 is another product of the present invention. Generally, to remove residual solvent, the product is forwarded to a solvent removal zone 36, such as a steam distillation unit. The resultant dry solid coal 69 is a highly beneficiated product having an ash content of from about 0.5 to about 10%; a sulfur content of from about 0.5 to 1 and a moisture content of from about 2 to 8%.

As shown in FIG. 3, the process hrein includes provisions for recycling many of process reagents, solvents, etc. That is, for example, solvent which is removed from drying zone 48 via line 71 may be collected in a condensing zone 38 wherein th.e condensed solvent is then recycled by way of line 73 to a holding tank 40 whereby solvent contained therein is recycled via line 75 to high shear mix zone 12. Solvent removed in zone 36 is sent back to high shear mix zone 24, 28 or 32 via lines 77, 77A and 77B after being condensed in zone 42. Water coming from waste treatment unit 44 is recycled to holding tank 40 via line 79, which water is in turn recycled to pulverization zone 10 via line 81.

Any polymerizable monomer can be employed in the process herein where so specified. While it is more convenient to utilize monomers which are liquid at ambient temperature and pressure, gaseous monomers which contain olefinic unsaturation permitting polymerization with the same or different molecules can be used. Thus, monomers intended to be.employed herein may be characterized by the formula XHC=CHX' wherein X and X' each may be hydrogen or any of a wide variety of organic radicals or inorganic substituents. Illustratively, such monomers include ethylene, propylene, butylene, tetrapropylene, isoprene, butadiene, such as 1,4-butadiene, pentadiene, dicyclopentadiene, octadiene, olefinic petroleum fractions, styrene, vinyltoluene, vinylchloride, vinylbromide, acrylonitrile, methacrylonitrile, acrylamide, methacrylamide, N-methylolacrylamide, acrolein, maleic anhydride, maleic acid, fumaric acid, abietic acid and the like.

A preferred class of monomers for the purposes of the present invention are unsaturated carboxylic acids, esters, or salts thereof, particularly, those included within the formula $$RC(=O)-OR'$$

wherein R is an olefinically unsaturated organic radical, preferably containing from about 2 to about 30 carbon atoms, and R' is hydrogen, a salt-forming cation such as an alkali metal, alkaline earth metal or ammonium cation, or a saturated or ethylenically unsaturated hydrocarbon radical, preferably containing from 1 to about 30 carbon atoms, either unsubstituted or substituted with one or more halogen atoms, carboxylic acid groups and/or hydroxyl groups in which the hydroxyl hydrogens may be replaced with saturated and/or unsaturated acyl groups, the latter preferably containing from about 8 to about 30 carbon atoms. Specific monomers conforming to the foregoing structural formula include unsaturated fatty acids such as oleic acid, linoleic acid, linolenic, ricinoleic, mono-, di- and tri-glycerides, and other esters of unsaturated fatty acids, acrylic acid, methacrylic acid, methyl acrylate, ethylacrylate, ethylhexylacrylate, tertiarybutyl acrylate, oleylacrylate, methylmethacrylate, oleylmethacrylate, stearylacrylate, stearylmethacrylate, laurylmethacrylate, vinylstearate, vinylmyristate, vinyllaurate, soybean oil, dehydrated castor oil, tall oil, corn oil and the like. For the purposes of this invention, tall oil and corn oil are particularly advantageous. Thus, it is clearly understood that compositions containing compounds within the foregoing formula in addition containing, for example, saturated fatty acids such as palmitic, stearic, etc. are also contemplated herein.

The amount of polymerizable monomer will vary depending upon the results desired. In general, however, monomer amounts of from about 0.0025 to about 2% by weight of carbonaceous material are used.

The catalysts employed in the practice of the present invention are any such materials commonly used in polymerization reactions. Typically, for the purposes of this invention, any catalytic amount of those catalysts, which are commonly referred to as free radical catalysts, or catalyst system (which can also be referred to as addition polymerization catalysts, vinyl polymerization catalysts or polymerization initiators) are preferred. Thus, illustratively, catalysts contemplated herein include benzoyl peroxide, methylethyl ketone peroxide, tertbutylhydroperoxide, hydrogen peroxide, ammonium persulfate, di-tert-butylperoxide, tertbutylperbenzoate, peracetic acid and the like.

Moreover, free radical polymerization systems commonly employ free radical initiators which function to help initiate the free radical reaction. For the purposes herein, any of those disclosed in the prior art, particularly those disclosed, for example, in U.S. Pat. No. 4,033,852, incorporated herein by reference, may be used. Specifically, some of these initiators include, for example, sodium persulfate, potassium persulfate, silver acetate, ammonium persulfate, salts of noble metals such as platinum and gold, and salts of iron, zinc, arsenic, antimony, tin and cadmium. Particularly preferred initiators herein are copper salts, i.e. cuprous and cupric salts, such as copper acetate, copper sulfate and copper nitrate. Most advantageous results can be obtained herein with cupric nitrate, $Cu(NO_3)_2$. Further initiators contemplated herein are also disclosed in U.S. patent application Ser. No. 06/230,061 filed concurrently herewith, commonly assigned herewith and incorporated herein by reference. These initiators include metal salts of naphthenates, tallates, octanoates, etc. sald metals including copper, cobalt, mercury, chromium, manganese, nickel, tin, lead, zinc, iron, rare earth metals and mixtures thereof. The amounts of catalysts contemplated herein are within the range of 10 to 1000 ppm (based on the weight of the solid carbonaceous materials, such as dry coal).

The amounts of water soluble or water insoluble liquid organic mediums utilized herein in the various zones 0.25 to 2% based on the weight of solid carbonaceous material, such as dry coal.

The amounts of water utilized in the various flotation zones and flotation recovery zones herein include from 65% to 95% based on the weight of carbonaceous material, such as dry coal.

All percentages hereinabove are based on the weight of dry coal unless otherwise specified.

The coal resulting from reaction with the hereinbefore described polymerizable mixture is extremely hydrophobic and oleophilic and consequently readily floats and separates from the aqueous phase. The floating hydrophobic coal is readily separable from the aqueous phase (for example, a skimming screen may be used for the separation) and can thereafter be readily introduced for further treatment as described hereinbefore. Copending U.S. patent application Ser. Nos. 114,357 and 114,414 incorporated herein by reference describe this reaction in detail. While it is not completely understood, it is believed that the polymerization reaction involves the formation of a polymeric organic coating on the surface of the coal by molecular grafting of polymeric side chains on the coal molecules.

It is also to be understood herein that any of the zones illustrated in FIGS. 1–3 may comprise a single vessel or zone or any number of vessels or zones arranged in a manner suitable and in accordance with carrying out the process of this invention as described herein. That is, for example, any number of high shear mix zones, flotation zones, etc. may be employed in series and arranged and employed in a monomer as shown herein in order to carry out the process of this invention.

In order that those skilled in the art may better understand how the present invention is practiced, the following example is presented by way of illustration and not by way of limitation.

EXAMPLE 1

200 grams of lignite coal are pulverized in a wet ball mill, containing 0.125% sodium carbonate, to 80% −200 mesh. The coal to water ratio in the pulverization zone is 1:2. 400 cc. of toluene and 200 ppm of cupric nitrate is added to the aqueous coal slurry. No. 2 fuel, (0.25%) oleic acid (0.125%), hydrogen peroxide (200 ppm) and 100 ppm of methyl isobutylcarbinol (frothing agent). (The use of methylisobutylcarbinol is disclosed and claimed in copending U.S. patent application Ser. No. 06/230,061, filed concurrently herewith). The entire admixture is placed in a blender and agitated under high shear conditions for 2–10 minutes. The blended admixture is removed from the blender and admixed with 4 liters of water in a flotation vessel or cell. The admixture is mixed for 4 minutes and the aqueous phase is drained from the vessel. 4 liters additional water is added to the vessel containing the coal froth and the mixture is agitated by the spray addition of further coal-aqueous slurry. This operation is repeated.

All the recovered coal froth phases are combined and vacuum filtered.

50 grams of the vacuum dried coal is placed in a blender containing tetrahydrofuran (THF), 500 ppm copper naphthenate, 25 ppm hydrogen peroxide and 0.06% oleic acid. The mixture is high shear blended for 2–10 minutes. The resultant admixture is vacuum filtered. The filtrate is roto-vacuum dried to concentrate the extract (residual water and toluene separate, i.e.

water is obtained at the bottom of the vacuum flasks and the toluene evaporates). To the remaining filter cake is added THF, copper naphthenate, hydrogen peroxide and oleic acid in the amounts specified above and the mixture is high shear agitated. (In the alternative, only THF need be used or THF and catalyst and/or initiator, etc.). The extraction procedure, i.e. vacuum drying, as described before is carried out. This high shear procedure is carried out 3 more times. The liquid extracts are combined, and the solid residual coal portion is finally dried under vacuum, thereby recovering the THF which can be recycled for use in the extraction procedure. All percentages and ppm in this example are based on the weight of dry coal in the process.

Obviously, other modifications and variations of the present invention are possible in light of the above teachings. It is therefore to be understood that changes may be made in the particular embodiments of this invention which are within the full intended scope of the invention as defined by the appended claims.

We claim:

1. A process for the beneficiation of low rank coal, said process comprising the steps of:

(a) subjecting raw low rank coal to treatment with a liquid water-insoluble organic medium., said liquid water-insoluble organic medium having a boiling point in the range of from about 40° to about 80° C., under high shear agitation; and (b) recovering the coal product resulting therefrom.

2. The process of claim 1 wherein the raw, low rank coal is pulverized in the presence of water prior to step (a).

3. The process according to claim 1 wherein the liquid organic medium is selected from the group consisting of benzene, toluene, xylene, hydrocarbon oils, pyridine, ethyl acetate and mixtures thereof.

4. The process according to claim 1 wherein the amount of liquid organic medium is from about 0.25 to about 2% by weight of the total solid carbonaceous material.

5. The process of claim 1 wherein the liquid hydrocarbon medium is selected from the group consisting of benzene, toluene and mixtures thereof.

6. The process of claim 1 wherein the liquid organic medium further contains a polymerizable monomer, a free radical polymerization catalyst and a free radical initiator.

7. A process for the beneficiation and/or liquefaction and recovery of low rank coal comprising the steps of:

(a) subjecting raw low rank coal to an initial treatment by admixing said low rank coal with a water-insoluble liquid organic medium, said water-insoluble liquid organic medium having a boiling point in the range of from about 40° C. to about 80° C., under high shear agitation;

(b) subjecting the coal product resulting from step (a) to further treatment by admixing said low rank coal with an aqueous medium, thereby resulting in a coal froth phase and an aqueous phase; and (c) removing said coal froth phase from said aqueous phase, said aqueous phase containing ash, and residual coal particles.

8. The process according to claim 7 wherein said aqueous medium contains in addition to water a polymerizable monomer, a free-radical catalyst and a free-radical initiator.

9. The process according to claim 7 including the further steps of:

(d) admixing the aqueous phase of step (b) with an aqueous medium, thereby resulting in a further coal froth phase and an aqueous phase;

(e) removing the coal froth phase from said aqueous phase of step (d); and (f) recycling the coal froth phase of step (d) to the high shear admixture treatment according to step (a).

10. The process according to claim 9 including the further steps of:

(g) admixing the aqueous phase from step (d) with an aqueous medium, thereby resulting in a further coal froth phase and an aqueous phase;

(h) recycling the coal froth phase of step (g) to the aqueous medium of step (d); and (i) removing the aqueous phase of step (g).

11. The process of claim 10 which further includes the step of:

(j) admixing the coal froth above from step (c) with an aqueous medium thereby resulting in a coal froth phase and an aqueous phase.

12. The process of claim 11 which further includes the steps of:

(k) recycling the aqueous phase resulting from step (j) to the aqueous medium of step (b); and (l) admixing the coal froth phase resulting from step (j) with a further aqueous medium, thereby resulting in a coal froth phase and an aqueous phase; and (m) recycling the aqueous phase resulting in step (l) to the aqueous medium of step (j).

13. The process of claim 12 wherein any or none of the aqueous mediums of steps (b), (d), (g), (j) and (l) contains, in addition to water, a polymerizable monomer, a free radical catalyst and a free radical initiator.

14. The process of claim 10 including the further steps of:

(n) separating the coal from the coal froth phase resulting from step (1) and removing residual water and residual water-insoluble liquid organic medium therefrom.

15. The process of claim 12 including the further step of:

(o) admixing the coal from the coal froth phase resulting from step (1) with a liquid organic medium under high shear agitation.

16. The process of claim 15 wherein said liquid organic medium comprises in addition to an organic liquid, a polymerizable monomer, a free-radical catalyst and a free-radical initiator.

17. The process of claim 16 including the further steps of:

(p) separating the liquids fraction from the solids fraction resulting from step (o); and (q) removing residual liquid organic medium from the liquids fraction of step (p) thereby resulting in a liquefied coal extract product.

18. The process of claim 17 including the further steps of:

(r) admixing the solids fraction of step (p) with a further liquid organic medium under high shear agitation;

(s) separating the liquids fraction from the solids fraction resulting from step (r); and (t) removing residual liquid organic medium from the liquids fraction of step (s) thereby resulting in a liquefied coal extract product.

19. The process of claim 18 including the further steps of:

(u) admixing the solids fraction of step (s) with a further liquid organic medium under high shear agitiation;

(v) separating the liquids fraction from the solids fraction resulting from step (u);

(w) removing residual liquid organic medium from the liquids fraction of step (v) thereby resulting in a liquefied coal extract product; and (x) drying and recovering the solid coal product in the solids fraction of step (v).

20. The process of claim 19 wherein the liquid organic medium of step (s) contains a polymerizable monomer, a free-radical catalyst and a free-radical initiator.

21. The process of claims 17, 18, 19 or 20 wherein the residual organic liquid medium removed from the liquids fractions is recycled to a high shear agitation admixture step.

22. The process of claim 10 including the further steps of separating the water from the aqueous phase of step (i) and recycling the separated water to a coal pulverization zone.

23. A beneficiated low rank coal product prepared by the process of claim 1, said beneficiated coal product having an ash content in the range of from about 1 to about 10% and a sulfur content of from about 0.1 to about 6%, all percents based on the weight of dry coal.

24. The beneficiated coal product of claim 23 wherein the sulfur content is in the range of from about 0.3 to about 2%, all percents based on the weight of dry coal.

25. A beneficiated coal product prepared by the process of claim 7, said beneficiated coal product having an ash content in the range of from about 0.5 to about 10% and a moisture content of from about 0.2 to about 15%, all percents based on the weight of dry coal.

26. A beneficiated liquefied coal extract prepared by the process of claim 17 said beneficiated liquefied coal extract having an ash content of from about 0.1 to about 2% and a sulfur content of from about 0.1 to about 3%, all percents based on the weight of dry coal.

27. A beneficiated liquefied coal extract according to claim 26 having an ash content of from about 0.2 to about 1%, and a sulfur content of from about 0.2 to about 1%, all percents based on the weight of dry coal.

* * * * *

UNITED STATES PATENT AND TRADEMARK OFFICE

CERTIFICATE OF CORRECTION

PATENT NO. : 4,671,801

DATED : June 9, 1987

INVENTOR(S) : Burgess et al.

It is certified that error appears in the above-identified patent and that said Letters Patent is hereby corrected as shown below:

| | |
|---|---|
| Column 6, Line 34, | "mixtures" should be --mixture--; |
| Column 10, Line 5, | "66.1" should be --66.--; |
| Column 10, Line 25, | "hrein" should be --herein--; |
| Column 10, Line 29, | "th.e" should be --the--; |
| Column 11, Line 59, | "230,061" should be --230,063--; |
| Column 11, Line 62, | "sald" should be --said--; |
| Column 13, Line 25, | "medium." should be --medium--. |

Signed and Sealed this

Twelfth Day of January, 1988

*Attest:*

*Attesting Officer*

DONALD J. QUIGG

*Commissioner of Patents and Trademarks*